US006460191B1

(12) United States Patent
Lorkovic

(10) Patent No.: US 6,460,191 B1
(45) Date of Patent: Oct. 8, 2002

(54) STICKY PAWS

(76) Inventor: Tammy Yvette Lorkovic, 2135 S. Houston Ave., Humble, TX (US) 77396

( * ) Notice: Subject to any disclaimer, the term of this patent is extended or adjusted under 35 U.S.C. 154(b) by 0 days.

(21) Appl. No.: 09/747,532

(22) Filed: Dec. 23, 2000

(51) Int. Cl.[7] ..... A41D 19/00
(52) U.S. Cl. ..... 2/161.8; 15/227
(58) Field of Search ..... 2/158, 159, 160, 2/161.6, 161.8; 15/227

(56) References Cited

U.S. PATENT DOCUMENTS 3,056,154 A * 10/1962 Neal ..... 2/159
5,280,664 A * 1/1994 Lin ..... 15/247
6,024,970 A * 2/2000 Woodard ..... 424/402

* cited by examiner

*Primary Examiner*—Peter Nerbun
*Assistant Examiner*—Katherine Moran

(57) ABSTRACT

An over-sized, adhesive decorative paw-shaped animal hair removal glove, which has greater manipulability, control and a greater cleaning coverage area as its over-sized design provides space within the glove not only for the thumb but, also for partial finger separations which allow for finger control thus, solving the problem of inadequate control and manipulability by products which do not allow finger separations, or if they do they are small human-hand types instead of an over-sized paw-shape. The paw-shape increases the coverage area of the surface to be cleaned allowing the task to be completed in a timely fashion and/or without the use of additional materials, which can prove costly.

1 Claim, 1 Drawing Sheet

FIG. 2
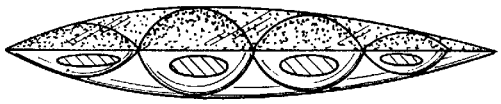
FIG. 1
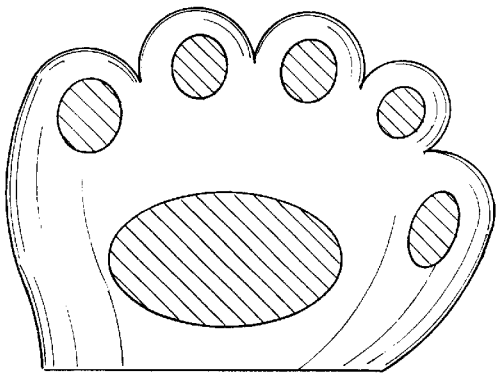
FIG. 4
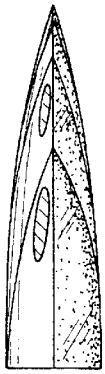
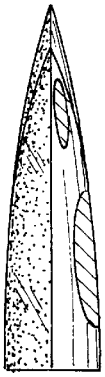
FIG. 3
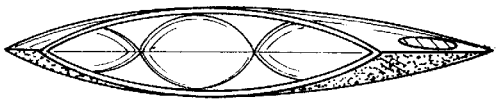
FIG. 5
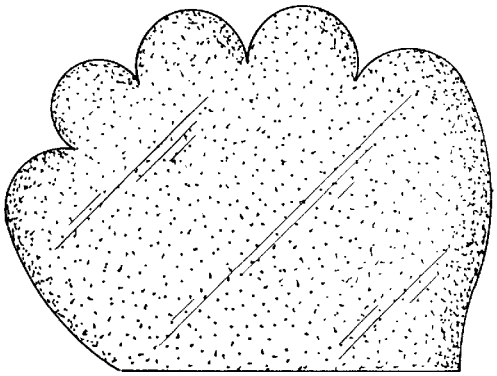
FIG. 6

STICKY PAWS

CROSS REFERENCE TO RELATED APPLICATIONS

Design Patent Application Ser. No.: 29/134.483 for the "STICKY PAWS" top cover design for the glove filed the 23rd of December 2000 by Tammy Lorkovic.

"The adhesive decorative glove named "STICKY PAWS" is used to remove pet hair and lint from clothing and furniture and can be worn as a glove while in use and then discarded in a waste receptacle."

STATEMENT TO RIGHTS TO INVENTIONS MADE UNDER FEDERALLY SPONSORED RESEARCH AND DEVELOPMENT

Not Applicable.

REFERENCE TO A "MICROFICHE APPENDIX"

Not Applicable.

BACKGROUND OF THE INVENTION

1. Field of Invention

This invention generally relates to mitts/gloves for removing lint and animal hair from a selected surface, and more particularly to adhesive mitts/gloves for removing lint and animal hair from surfaces such as, but not limited to, clothing, furniture, automobile upholstery, and the like, and the methods of using same.

2. Description of Related Art

Pet owners and others have looked towards the several developed devices and materials for removing unwanted animal hair from their clothing, furniture and automobile upholstery, and the like; however, the devices and materials can fall short in the various areas of manipulability, control, coverage area, or adhesion ability.

Prior art, which is most used for removing animal hair off clothing, and the like, includes a roller having a roll of small sheets of adhesive tape thereon. Roll and roller-type devices, such as U.S. Pat. Nos. 2,702,913 and 4,427,726, respectively, can prove to be useful, but lack manipulability, and control. And their coverage areas are small and the adhesive ability can be less sufficient and thus, more suited for lint than animal hair removal.

Adhesive tape alone presents the same problems as with the roll and roller-type devices. The hand-sack like devices known, and shown, in U.S. Pat. Nos. 4,820,558; 3,103,029; 3,056,154; 3,082,453; 2,724,847 may roll about during the lint removal process thereby, they provide little control.

Although, U.S. Pat. No. 3,056,154 does provide in addition to the hand-sack stated above, a glove having pads on the finger "stalls" for manipulability, the coverage area for the finger stalls would be exceedingly small as they represent the human-hand. A small coverage area would take more time to complete the task and the limited amount of adhesive space would wear out very fast, thus creating the need for the use of more gloves for a single task.

The coverage-area problem mentioned in the preceding graph is also present in U.S. Pat. No. 5,280,664. Whereby, the adhesive strips are small and cover too small an area when removing lint or other fibrous materials to complete the task in a timely fashion. In addition, this device has the sack-type design, which contributes to a rolling and control problem, as there is not an area for the thumb.

While a thumb area built into a mitt does provide addition control as is present in U.S. Pat. No. 6,024,970, the mitt portion limits critical additional fingertip movement for control needed for lint removal with its sack-type mitt covering all of the fingers. This mitt also fastens about a user's wrist, which will slow the process of removing the mitt from the hand after use. In addition, the hand-mitt size limits the coverage area for lint removal. Furthermore, the adhesive as described seems more suitable for lint removal instead of animal hair, which usually requires a stronger adhesive.

Therefore, there is a need felt within the art for an animal hair removal device adapted to the user's hand, where the paw-shaped glove provides for improved manipulability, and control, where the paw-shaped glove provides sufficient amount of space within the paw-shaped glove for a user's thumb and through partial separations for each finger the paw-shaped glove provides fingertip manipulability, thus providing improved control, where the paw-shaped glove is larger than a traditional hand design, thus a larger coverage area would be cleaned of animal hair, where a more sufficient adhesive specific to the removal of animal hair removal would be utilized, and where to summarize, a paw-shaped glove would provide an improved manipulability, control, with more coverage area and more sufficient adhesive for a faster and easier task of removing animal hair from clothing, furniture, automobile upholstery, and the like.

BRIEF SUMMARY OF INVENTION

The present invention defines an apparatus for removing animal hair, which comprises an adhesive decorative paw-shaped glove for the user's hand, which provides for additional manipulability and control, maximum coverage area, and extra-strength adhesive for expedited pet hair removal. The cover of the paw-shaped glove would display a decorative printed paw design (please see design patent appl. Ser. No. 29/134.483 filed Dec. 23, 2000 by Tammy Lorkovic). The palm side of the paw-shaped glove is entirely covered by a strong adhesive to adhere animal hair to the adhesive, which is stronger than an adhesive more suited for lint. The glove also has a top and a bottom end, where the cover has an opening at the bottom end, which allows the insertion of the user's hand into the inner retaining area. The inner retaining area is over-sized as it is shaped into a paw-shape for maximum coverage area while removing animal hair, instead of the usual hand-size of previous designs. Additionally, the advantage is an inner retaining area has partial separations for the thumb and each of the fingertips for holding the paw-shaped glove about the user's thumb and each of the fingers thus, allowing for manipulability and control, instead of a mitt that limits manipulability and control by covering all of the fingers with a sack-like design. The partial separation for the thumb and each of the fingertips provides that the paw-shaped glove is retained on the user's hand insomuch as the palm is held adjacent to the palm surface and cover of the paw-shaped glove is held adjacent to the back of the user's hand. With the partial separations for the thumb and each of the fingers the paw-shaped glove is retained in a non-rolling position about the user's hand. Another advantage is the entire palm side of the paw-shaped glove is covered with the extra-strength adhesive, which allows for a greater coverage area on the surface that is to be cleaned, thereon the paw-shaped adhesive adheres animal hair thereto when a user disposes the palm side of the paw-shaped glove to an animal hair covered surface.

The present invention also defines a method for providing an animal hair removal device. The paw-shaped glove, which has a decorative cover displaying a paw design (please see design patent appl. Ser. No. 29/134.483 filed 23 Dec. 2000 by Tammy Lorkovic) and the palm side is entirely covered by a strong adhesive sufficient to adhere animal hair to the adhesive. The glove also has a top end and a bottom end, and an opening at the bottom end, which allows the insertion of the user's hand into the inner retaining area. The inner retaining area is over-sized as it is shaped into a paw-shape for maximum coverage area while removing animal hair. The inner retaining area has partial separations for the thumb and each of the fingers for holding the paw-shaped glove about the user's hand. With the user's thumb and each of the user's finger in their respective partial separations the paw-shaped glove will provide for manipulability and control of the glove.

The method includes inserting the user's hand into the opening at the bottom of the glove into the inner retaining area. In this manner, the thumb and each of the fingers is retained in each of their partial separations compartments of the glove allowing for easy manipulation and control of the glove. The user then places palm side of the glove on an animal hair covered surface, such as clothing, furniture, automobile upholstery, and the like, where entire palm side of the paw-shaped glove is covered with the extra-strength adhesive to remove the animal hair off the covered surface.

The objectives of the present invention are to provide an animal hair removal device, which has which has greater manipulability, control, greater coverage area and a more suited stronger adhesive. The over-sized paw-shaped design with thumb and finger separations meets these objectives. Manipulability and control is attained by providing space within the glove not only for the thumb but, also space for partial finger separations for fingertip control and thus, solving the problem of inadequate control and manipulability suffered by previous products which do not allow finger separations, or if they do provide finger separations the finger separations are to small, as they represent the human-hand instead of a paw-shape, to complete the task in a timely fashion and/or without the use of additional materials, which can prove costly. It is a further objective that the adhesive is to be disposed on the entire underside of the over-sized paw-shaped glove for the hand, which will have a greater coverage area, in order to expedite the process of animal hair removal thus, solving the problem of a smaller coverage area by limiting the adhesive to only a portion of a mitt or glove device. It is a further objective that the adhesive be extra-strength in order to expedite the process of animal hair removal. Adhesive predominately for lint removal tend to a lesser strength adhesive, which can cause the user to employ additional materials to complete a single task, thereby costing the user additional time and money. It is a further objective of the present invention to be easily slipped on and easily slipped off the user's hand, instead strapping a glove to the wrist. It is a further objective of the present invention that the paw-shaped glove be completely disposable, solving the problem of dealing with problematic used adhesive and disposing the removed pet hair. It is a further objective of the present invention that the paw-shaped glove be easily and economically manufactured, due to its simple construction.

BRIEF DESCRIPTION OF THE DRAWINGS

Other objects, features and advantages of the present invention will become more fully apparent from the following listing of all figures by number, the accompanying listed claims and the accompanying drawing in which:

FIG. 1 is a front cover view of the "STICKY PAWS" glove showing my new paw design and shape;

FIG. 2 is a top view of the "STICKY PAWS" glove; thereof

FIG. 3 is the left side view of the "STICKY PAWS" glove; thereof

FIG. 4 is the right side of the "STICKY PAWS" glove; thereof

FIG. 5 is the bottom side and opening of the "STICKY PAWS" glove; thereof

FIG. 6 is the rear/palm view entirely covered by adhesive, which is furthermore covered by a removable film backing for protecting the adhesive thereof.

DETAILED DESCRIPTION OF THE INVENTION

Apparatus, and methods for removing pet hair, have been known in the art. However most of apparatus and methods did not provide additional manipulability, control, maximum coverage area, and a more suited stronger adhesive in one product for fast pet hair removal from clothing, furniture, automobile upholstery, and the like.

The first of the present invention's improvements is the partial separations for the thumb and each of the fingers for allowing the over-sized adhesive decorative paw-shaped glove to be more controlled by the user's hand with the thumb and each of the fingers allowing for additional manipulability and control as can be seen in FIG. 1, the front design view, and FIG. 6, the bottom adhesive view, which is covered by a removable protective backing, instead of older designed mitts that limits manipulability and control by covering all of the fingers with a sack-like design, or if they do provide finger separations the finger separations are to small, as the finger separations represent the human-hand instead of a paw-shape, then the smallness of the human-hand design would not allow the user to complete the task in a timely fashion and/or without the use of additional materials, which can prove costly. With the partial separations for the thumb and each of the fingers the paw-shaped glove is retained in a non-rolling position about the user's hand. The second improvement with the present invention's paw-shaped design, seen in FIG. 1 and FIG. 6, provides for that the over-sized paw-shaped glove's adhesive area to create a greater cleaning coverage area while still maintaining manipulability and control. The third present invention's improvement is that the decorative paw-shaped glove utilized the entire underside of the glove as it is coated with an extra-strength adhesive, which is stronger than an adhesive more suited for lint, which allows for a greater coverage area on the surface that is to be cleaned, thereon the paw-shaped adhesive adheres animal hair thereto when a user disposes the palm side of the paw-shaped glove to an animal hair covered surface. The adhesive is protected until ready for use by a removable film backing, as seen in FIG. 6. An adhesive that is lesser in strength can cause the user to employ additional material to complete a single task, thereby costing the user additional time and money. Additionally, the back of the paw-shaped glove displays a decorative printed paw design (please see design patent appl. Ser. No. 29/134,483 filed Dec. 23, 2000 by Tammy Lorkovic), for which the design indicates that the paw-shaped glove is for use for the removal of pet hair.

The glove also has a top as seen in FIG. 2, and a bottom end, where the cover has an opening at the bottom end, please see FIG. 5, which allows the insertion of the user's hand into the inner retaining area. The inner retaining area is over-sized as it is shaped into a paw-shape for maximum coverage area while removing animal hair, instead of the usual hand-size previous designs; and the partial separations allows for control of the glove. The partial separation for the thumb and each of the fingertips provides that the paw-shaped glove is retained on the user's hand insomuch as the palm is held adjacent to the palm surface and cover of the paw-shaped glove is held adjacent to the back of the user's hand.

FIGS. 3 and 4 display the left and right side respectively, and furthermore display the joining/meeting of the adhesive palm side to the front side, as also demonstrated in FIG. 2 and FIG. 5, where both side are joined/meet to form the glove.

The method includes inserting the user's hand into the opening at the bottom of the glove into the inner retaining area. In this manner, the thumb and each of the fingers is retained in each of their partial separation compartments of the glove allowing for easy manipulation and control of the glove. The user then places palm side of the glove on an animal hair covered surface, such as clothing, future, automobile upholstery, and the like, where entire palm side of the paw-shaped glove is covered with the extra-strength adhesive to remove the animal hair by patting, or manipulating the glove to reach specific hard to reach areas, or by moving the glove in a brushing motion over the surface to be cleaned.

To summarize, a goal of the present invention is to provide an over-sized paw-shaped animal hair removal glove device, which has greater manipulability and control by providing space within the glove not only for the thumb but, also space for partial finger separations allowing for finger control and a larger coverage area, and thus, solving the problem of inadequate control and manipulability suffered by previous products which do not allow finger separations, or if they do provide finger separations the finger separations are to small, as they represent the human-hand instead of a paw-shape, to complete the task in a timely fashion and/or without the use of additional materials, which can prove costly. It is a further objective that the adhesive is to be disposed on the entire underside of the over-sized paw-shaped glove for the hand, which will have a greater coverage area, in order to expedite the process of animal hair removal thus, solving the problem of a smaller coverage area by limiting the adhesive to only a portion of a mitt or glove device or a lesser strength adhesive, which may be predominately for lint removal. Insomuch as animal hair can be difficult to remove from an item such as clothing, furniture, automobile upholstery, and the like, an adhesive that is lesser in strength can cause the user to employ additional materials to complete a single task, thereby costing the user additional time and money. It is another goal of the present invention to be easily slipped on and easily slipped off the user's hand, instead strapping a glove to the wrist. Finally, it is a goal of the present invention for the over-sized paw-shaped glove to be completely disposable, thus eliminating the problem of dealing with used adhesive and disposing of removed pet hair. It is a further objective of the present invention that the paw-shaped glove be easily and economically manufactured, due to its simple construction.

Referring to FIGS. 1–6, the decorative paw-shaped adhesive glove would be constructed from recycled materials, preferably a strong paper, plastic, or combination thereof, which will not tear during use. The extra-strength adhesive on the underside of the glove would have a protective film covering, which would be removed once the glove is placed on the user's hand exposing the adhesive. The two sides of the glove, the top and underneath would be held together by a glue or compressed around the edges—except, of course, where the opening for the hand is located at the bottom of the glove.

I claim:

1. An over-sized, paw-shaped, disposable glove comprising: a palm side with adhesive applied to an entire surface, back-side, five finger portions, an opening at an opposite end thereof for the insertion and withdrawal of a user's hand, the finger portions including partial separations between each finger, the back-side further including decorative markings resembling a paw, the palm side further including a selectively removable film backing for protecting the adhesive qualities of the glove.

* * * * *